United States Patent [19]

Nagasaka et al.

[11] Patent Number: 4,796,578

[45] Date of Patent: Jan. 10, 1989

[54] ANTI-OVERRUNNING DEVICE FOR AN INTERNAL COMBUSTION ENGINE

[75] Inventors: Kohji Nagasaka, Kawasaki; Takeshi Kobayashi, Yokohama; Yoshimi Sejimo, Urayasu, all of Japan

[73] Assignee: Walbro Far East, Inc., Kawasaki, Japan

[21] Appl. No.: 102,383

[22] Filed: Sep. 29, 1987

[30] Foreign Application Priority Data

May 6, 1987 [JP] Japan ..... 62-110116

[51] Int. Cl.[4] ..... F02D 9/02

[52] U.S. Cl. ..... 123/378; 123/198 D; 123/376

[58] Field of Search ..... 123/332, 333, 351, 360, 123/376, 378, 392, 198 D

[56] References Cited

U.S. PATENT DOCUMENTS 3,650,252 3/1972 Glover et al. ..... 123/392

FOREIGN PATENT DOCUMENTS 172439 10/1983 Japan ..... 123/351
46344 3/1984 Japan ..... 123/378
228736 11/1985 Japan ..... 123/376
261940 12/1985 Japan ..... 123/378
1835 1/1986 Japan ..... 123/378

*Primary Examiner*—Tony M. Argenbright
*Attorney, Agent, or Firm*—Barnes, Kisselle, Raisch, Choate, Whittemore & Hulbert

[57] ABSTRACT

An anti-overrunning system for an internal combustion engine having a throttle valve in a carburetor in which an actuator for the throttle valve is responsive to pump pressure to move the valve to a closing position. A vibrating pump responsive to engine vibration is located to direct output control pressure to the actuator. A control valve between the pump and the actuator normally blocks pressure to the actuator but is responsive to air pressure from an engine cooling fan such that, upon overrun conditions, the fan pressure will actuate the control valve to connect the pump to the actuator to cause the throttle valve to move toward a closing position.

1 Claim, 7 Drawing Sheets

ANTI-OVERRUNNING DEVICE FOR AN INTERNAL COMBUSTION ENGINE

REFERENCE TO RELATED APPLICATIONS

Reference is made to the following United States applications which are assigned to an assignee common to the present application:

Ser. No. 102,113—Filed Sept. 29, 1987
Ser. No. 102,133—Filed Sept. 29, 1987
Ser. No. 102,134—Filed Sept. 29, 1987
Ser. No. 102,354—Filed Sept. 29, 1987

FIELD OF INVENTION

The present invention relates to a device for inhibiting overrunning of an internal combustion engine utilizing engine vibrations.

OBJECTS AND FEATURES OF THE INVENTION

Portable working machines generally use a two-stroke engine as a power source. Particularly, a diaphragm type carburetor is employed to thereby make it possible to operate a machine in all attitudes. Accordingly, the two-stroke engine is often used for a chain saw, a brush cutter, etc. Generally such a portable working machine is operated with a light-weight, small-size and high-output internal combustion engine in order to enhance the working properties. However, in the chain saw or the brush cutter, when a throttle valve of a carburetor is totally opened under circumstances of a light or no torque load, the engine starts overrunning wherein the R.P.M. becomes excessive and may cause damage to the engine before a load is applied. The overrunning operation can likewise occur after the cutting work has been completed and the torque load is removed.

The overrunning may be avoided if the throttle valve is restored to a low setting every time there is an interruption of the work. However, because the intermittent work is repeatedly carried out, the operator often fails to cut back the throttle, thus resulting in damage to and shortening of the life of the engine.

In the past, this overrunning has been controlled by supplying an overrich fuel mixture to the engine when a throttle valve is fully opened or nearly fully opened under conditions of no or low torque load. However, this system increases the fuel consumption. Also, the ignition plug can become easily fogged, and exhaust fumes increase. Tar or the like tends to accumulate in the muffler.

The present inventors have proposed an anti-overrunning device as disclosed in Japanese Patent Application Laid-Open No. 1835/1986. In this device, a vibrating pump is normally driven to directly supply pressure air to an actuator, but the diaphragm of the vibrating pump is always unsteady due to the vibrations of the engine and, as a result, the operating stability is poor. Also, it is difficult to set an actuating point at which a throttle valve is closed by an actuator during overrunning of the engine.

In view of the above-described difficulty, there has been proposed an arrangement wherein a control valve which is opened by vibrations of the engine when the latter is overrun is provided between a vibrating pump and an actuator. Even with this arrangement, the relationship between the number of revolutions of the engine and the strength of the vibration varies at the beginning of and end of the use of the engine, and such a relationship varies also due to the temperature of the engine or the like. Furthermore, in the above device there is an unevenness in the relationship between the number of revolutions of the engine and the strength of the vibration depending on individual engines. This cannot be said to be a completely satisfactory solution.

It is therefore an object of the invention to solve the aforementioned problem by providing an anti-overrunning device for an internal combustion engine in which an actuation point of the control valve is accurate, and thus the actuator is actuated by air pressure from the vibrating pump at a predetermined number of revolutions or more of the engine, and the throttle valve is automatically rotated in the closing direction.

In order to achieve the above-described object, the present invention provides an arrangement which comprises an actuator for actuating a throttle valve of a carburetor in a direction to close the valve, a control valve for controlling pressure to the actuator when the engine is overrun, and a vibrating pump actuated by the vibration of the engine, said control valve being actuated by air pressure of a cooling fan of the engine.

BRIEF DESCRIPTION OF THE OPERATION

Figure 1:
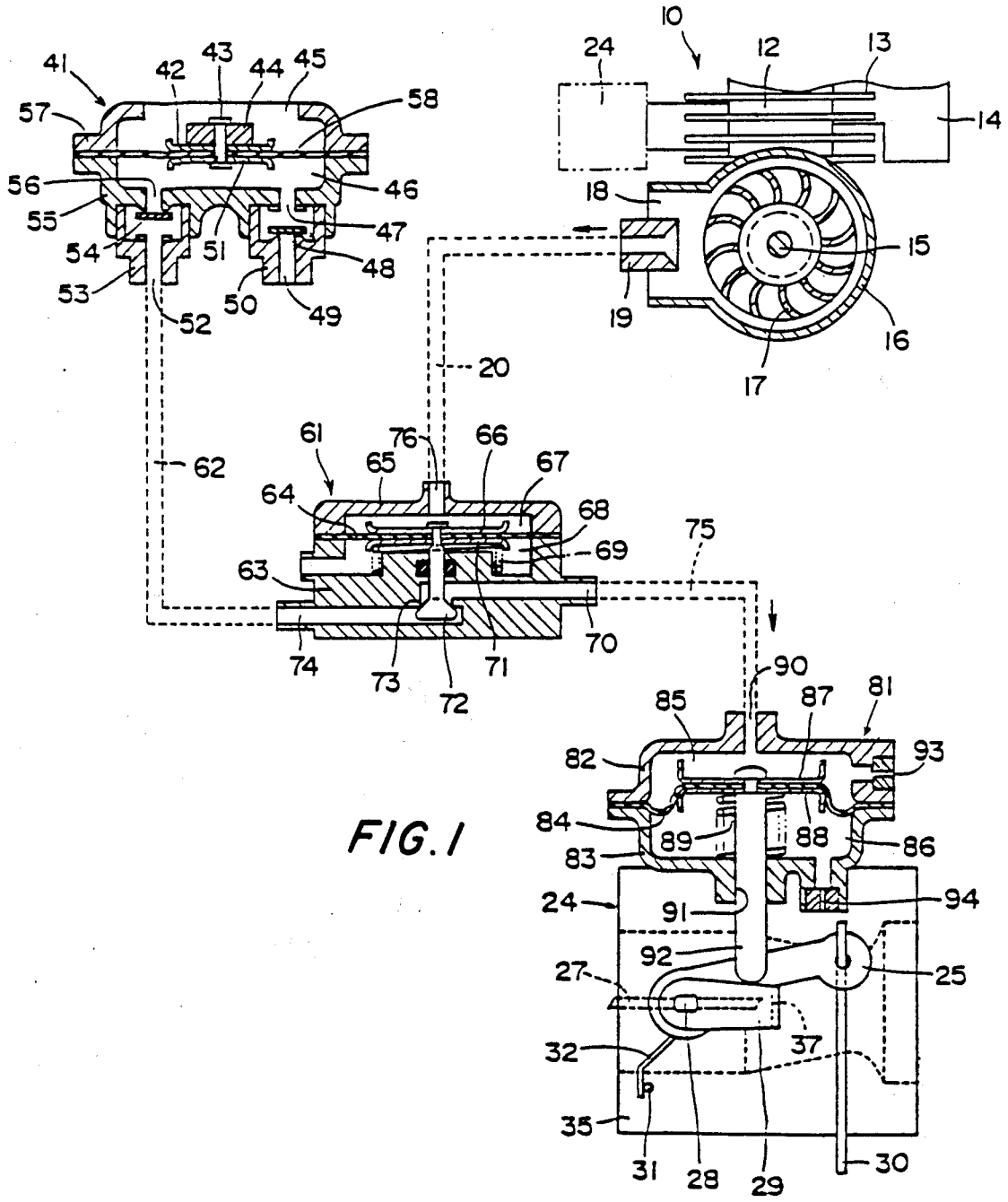
FIG. 1 is a side view showing the schematic structure of an anti-overrunning device for an internal combustion engine according to the present invention.

When the vibrating pump 41 mounted on an engine 10 is subjected to vibrations of the engine, the weight 44 as well as a diaphragm 58 supporting the weight 44 reciprocate, and positive or negative pressure air is supplied toward the actuator 81.

However, in the normal running condition of the engine, since the actuation of the vibrating pump 41 or actuator 81 is cancelled by the control valve 61, the rod 92 of the actuator 81 is retracted by the force of the spring 89.

When the engine starts to overrun, air pressure (positive or negative pressure) at an outlet port or an inlet port of the cooling fan 17 increases. This air pressure enters the pressure chamber 67 of the control valve 61 to effectively connect the vibrating pump 41 and the actuator 81.

Positive or negative air is supplied from the vibrating pump 41 to a pressure chamber 85 of the actuator 81, and the rod 92 is projected. A throttle valve lever 29 as well as a valve shaft 28 are rotated by the rod 92 to reduce the fuel-air opening of a passage controlled by the throttle valve 27. In this manner, the quantity of the fuel-air mixture supplied to the engine is reduced, as a consequence of which the number of revolutions of the engine is lowered and the overrunning is automatically prevented.

DETAILED DESCRIPTION OF THE INVENTION

As shown in FIG. 1, in the internal combustion engine 10, a carburetor 24 and a muffler 14 are connected to opposite sides of a cylinder body 12 having cooling fins 3. A cooling fan 17 driven by a crank shaft 15 is provided on the side of a crank case of the cylinder body 12 so that air around the cylinder body 12 and a cylinder head, not shown, is taken into a case 16 from an opening provided around the crank shaft 15, and is blown out of an outlet port 18 away from the engine 10. At the outlet port 18 is disposed an intake member 19 for receiving air pressure exiting from outlet port 18.

Figure 2:
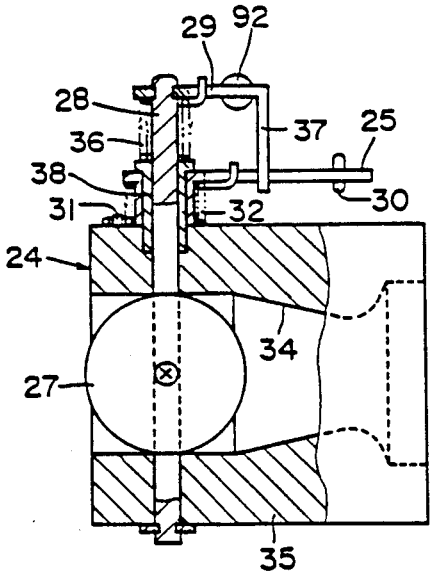
FIG. 2 is a horizontal sectional view of a carburetor to be provided with the anti-overrunning device.

As shown in FIG. 2, a throttle valve 27 is supported by the valve shaft 28 on a venturi 34 formed on the body 35 of carburetor 24, and fuel is supplied to the venturi 34 by negative pressure of air passing through the venturi 34. Such a fuel supplying mechanism is known, for example, in U.S. Pat. No. 3,738,623 and directly has nothing to do with the gist of the present invention, and will not be further described.

An upper end of the valve shaft 28 is rotatably supported on the body 35 by means of a bearing sleeve 38, and an inverted L-shaped throttle valve lever 29 is secured to the upper end. One end of a spring 36 wound around the valve shaft 28 is placed in engagement with the throttle valve lever 29 and the other end thereof placed in engagement with the bearing sleeve 28. Also, a boss portion of the lever 35 is slipped over the bearing sleeve 38, and one end of a spring 32 wound around the boss portion is placed in engagement with a pin 31 of the body 35. An engaging portion 37 of the throttle valve lever 29 is projected downwardly so that it may engage with the edge of the lever 25.

In FIG. 1, the throttle valve lever 29 is pivotally urged counterclockwise by the force of the spring 36 to cause the engaging portion 37 to abut against the lever 25. The lever 25 is pivotally urged clockwise by the strong force of the spring 32 to close the throttle valve 27. When the lever 25 is rotated counterclockwise against the force of the spring 32 by a trigger wire 30, the throttle valve lever 29 also follows the lever 25 to increase the opening of the throttle valve 27.

The anti-overrunning device for the internal combustion engine according to the present invention is composed of a vibrating pump 41, a control valve 61, and an actuator 81 for reducing the fuel-air opening controlled by the throttle valve 27 operated by the throttle valve lever 29.

The vibrating pump 41 has a diaphragm 58 sandwiched between cup-like housings 57 and 55 to form an atmospheric chamber 45 and a pressure chamber 46. Pad plates 42 and 51 are placed on both surfaces of a diaphragm 58, and a weight 44 is connected by means of a rivet 43. The pressure chamber 46 is provided with passages 56 and 47, to which port members 53 and 50, respectively, are connected. The port member 53 is provided with a check valve 54 to allow a flow of air from the passage 56 to a passage 52. The port member 50 is provided with a check valve 48 to allow a flow of air from an atmospheric opening 49 to the passage 47 through a strainer 60 (refer to FIG. 3). The passage 52 is connected to a passage 74 of the control valve 61 by a pipe 62.

The control valve 61 is divided into a pressure chamber 67 and an atmospheric chamber 68 by a diaphragm 64 held between a housing 65 and a housing 63, the pressure chamber 67 having a port 76 connected to the aforesaid air intake member 19 by means of a pipe 20. The housing 63 is provided with a passage 74 and a passage 70, and a poppet type valve body 72 cooperates with a valve seat 73 formed between said passages biased to a closed position by the force of a spring 69. A stem of the valve body 72 is coupled to pad plates 66 and 71 superposed on both surfaces of the diaphragm 64, and the spring 69 is interposed between the pad plate 71 and the housing 63. The passage 70 is connected to an inlet port 90 of an actuator 81 through a pipe 75.

The actuator 81 has a diaphragm 84 sandwiched between cup-like housings 82 and 83 to form a pressure chamber 85 and an atmospheric chamber 86. Pad plates 87 and 88 are placed on both surfaces of the diaphragm 84, the plates being connected by the base end of a rod 92. The rod 92, slidably inserted into a hole 91 of the housing 83, is retracted by means of a spring 89 surrounding the rod 92 and interposed between the pad plate 88 and the housing 83. The fore end of the rod 92 is placed into abutment with the aforementioned throttle valve lever 29. The pressure chamber 85 and the atmospheric chamber 86 are provided with orifices 93 and 94 in communication with atmosphere respectively, whereby the extreme operation of the actuator 81 may be restricted.

Figure 3:
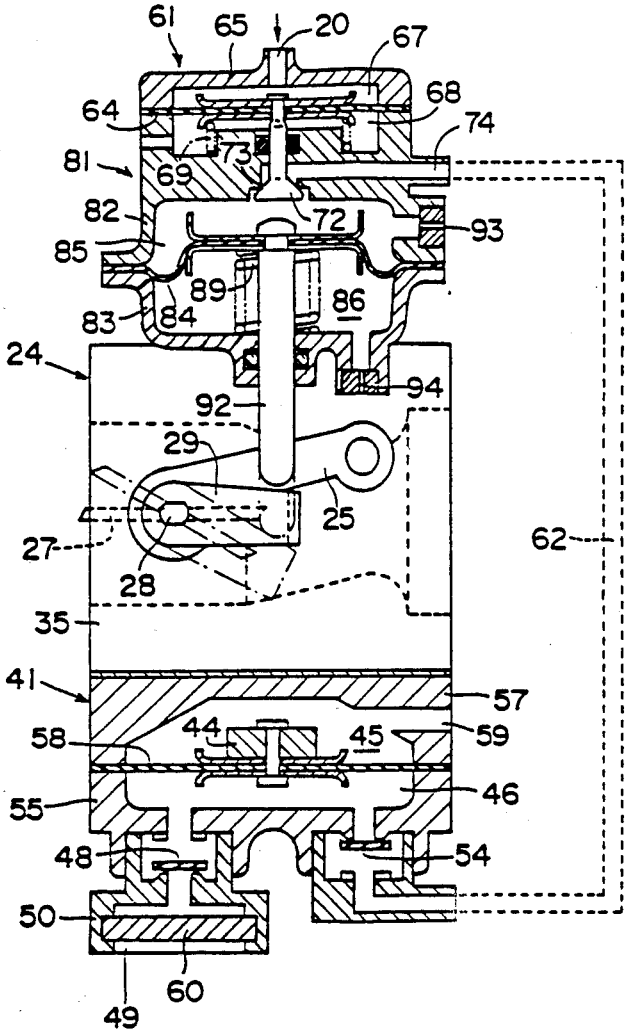
FIG. 3 is a side sectional view showing the manner in which the anti-overrunning device according to the first embodiment of the present invention is mounted on the carburetor.

The above-described vibrating pump 41 is preferably integrally connected to the lower end wall of the body 35 of the carburetor 24, and the control valve 61 and the actuator 81 are connected to the upper end wall of the body 35, as shown in FIG. 3. The vibrating pump 41 and the control valve 61 are connected by the pipe 62. However, the vibrating pump 41 and the control valve 61 may be mounted suitably on the engine 10.

In the following, the operation of the anti-overrunning device for the internal combustion engine according to the present invention will be described. Since under conditions where the engine is operating at less than a predetermined number of revolutions, air pressure of the outlet port 18 of the cooling fan 17 is low, and thus the force of air acting on the diaphragm 64 in the pressure chamber 67 of the control valve 61 is weak. The valve body 72 is held against the valve set 73 by the force of the spring 69.

Upon receipt of the vibration of the engine, the diaphragm of the vibrating pump 41 vibrates up and down because of the weight 44 supported on the diaphragm 58. When the diaphragm 58 is inflated upwardly, pressure of the pressure chamber 46 lowers, and therefore the check valve 48 opens to take air into the pressure chamber 46 from the atmospheric opening 49. Subsequently, when the diaphragm 58 is inflated downwardly, the pressure of the air in chamber 46 causes the check valve 54 to open and the air under pressure is discharged toward the pipe 62. However, since the passage 74 remains closed, even when the pressure in the pressure chamber 46 is relatively higher, the vibration of the diaphragm 58 is controlled.

When the engine is operating at a level above a predetermined number of revolutions, that is, in a overrunning state, the air pressure of the outlet port of the cooling fan 17 increases, and this pressure acts on the diaphragm 64 in the pressure chamber 67 of the control valve 61 and overcomes the force of the spring 69 to move the valve body 72 from the valve seat 73 to connect the passage 74 with the passage 70 and pipe 75 leading to the pressure chamber 85. The diaphragm 58 of the vibrating pump 41 is also increasingly vibrated by the weight 44, the air in the pressure chamber 46 is supplied to the pressure chamber 85 of the actuator 81 through the control valve 61, and the rod 92 is forced down against the force of the spring 89. Thus, the throttle valve lever 29 is rotated along with the valve shaft 28, as shown by the chain lines in FIG. 3, and the fuel-air opening controlled by the throttle valve 27 is reduced. The flow rate of the mixture taken into the engine is reduced, and the number of revolutions of the engine decreases.

When the number of revolutions of the engine decreases, the air pressure fed from the cooling fan 17 to the control valve 61 lowers, and the connection between the passages 74 and 70 is closed by the valve body 72. Then, the air in the pressure chamber 85 of the actuator 81 gradually flows outward through the orifice 93, and the rod 82 is raised upward by the force of the spring 89. The throttle valve lever 29 is then rotated counterclockwise by the force of the spring 36, and the engaging portion 37 impinges upon the edge of the lever 25. In this manner, the opening position of the throttle valve 27 increases, and again the number of revolutions of the engine increases.

In general, the position of the throttle valve 27 is determined by the rotated position of the lever 25 operated by the trigger wire 30. When the number of revolutions of the engine again increases and exceeds a predetermined number of revolutions, the control valve 61 again opens, and the fuel-air opening controlled by the throttle valve 27 is decreased by the actuator 81. The operation as described above is repeated whereby the speed of the engine is maintained at less than a predetermined number of revolutions, and the overrunning of the engine is automatically prevented without the need for the operator's operation of the trigger wire 30 in response to the variation of load.

Figure 4:
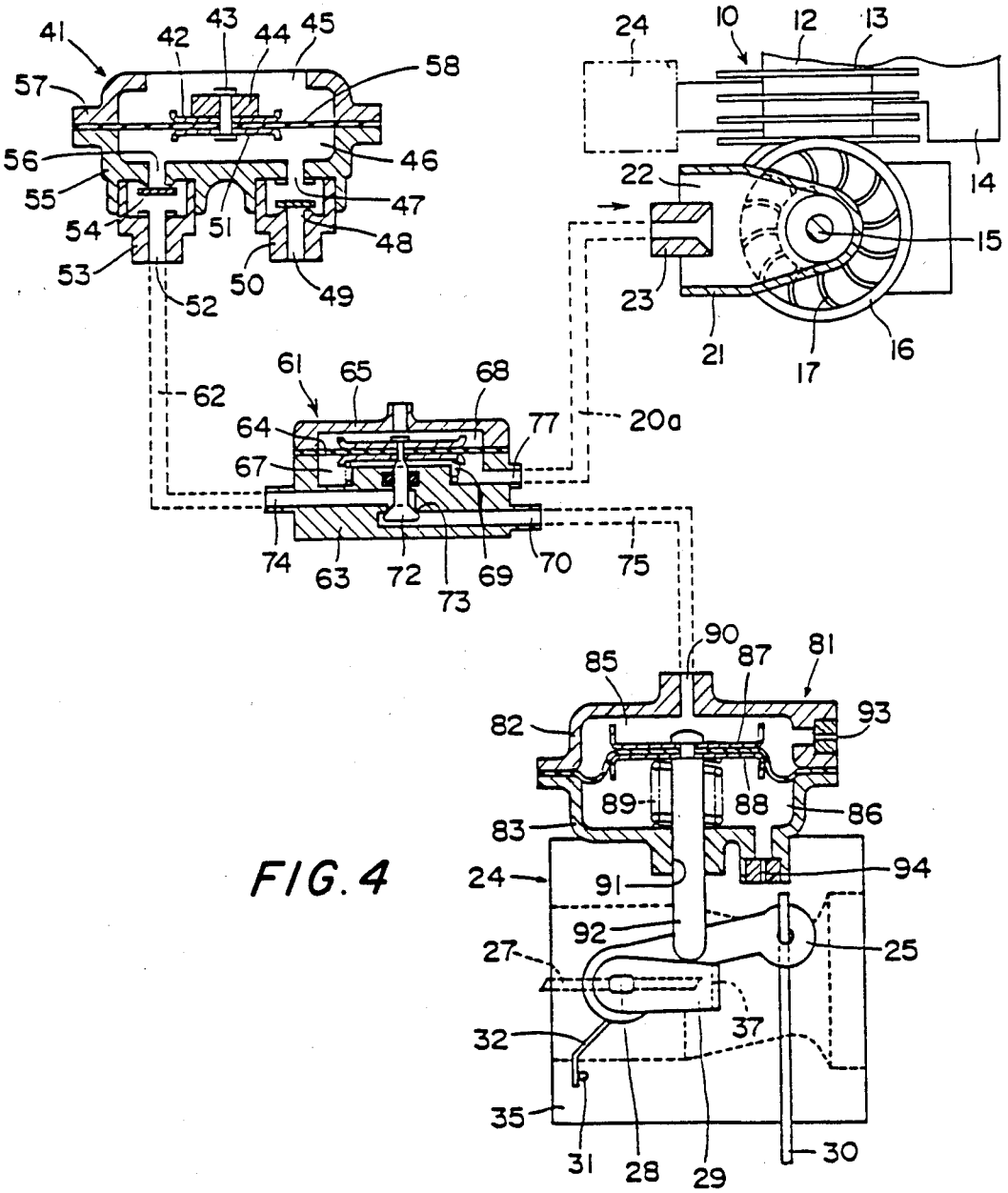
FIGS. 4–7 are side sectional views showing the anti-overrunning device according to the second to fifth embodiments of the present invention.

In the embodiment shown in FIG. 4, the valve body 72 of the control valve 61 is actuated by negative pressure generated by the cooling fan 17. That is, the cooling fan 17 sucks air from the inlet port 22 of the air intake pipe 21 in communication with an opening around the crank shaft 15 outside the engine and then blows out the air diametrically, outwardly and upwardly to cool the cylinder body 12. The intake member 23 disposed at the inlet port 22 is connected by a pipe **20*a* to a port 77 of a chamber under the diaphragm of the control valve 61, namely, pressure chamber 67. An upper chamber is an atmospheric chamber 68. The other structures of the control valve 61 are similar to those of the embodiment shown in FIG. 1**.

In this embodiment, when the engine exceeds a level of a predetermined number of revolutions, the negative pressure acting on the lower side of the diaphragm 64 overcomes the force of the spring 69 to force down the valve body 72 to provide communication between the passage 74 and passage 70 and pipe 75.

Figure 5:
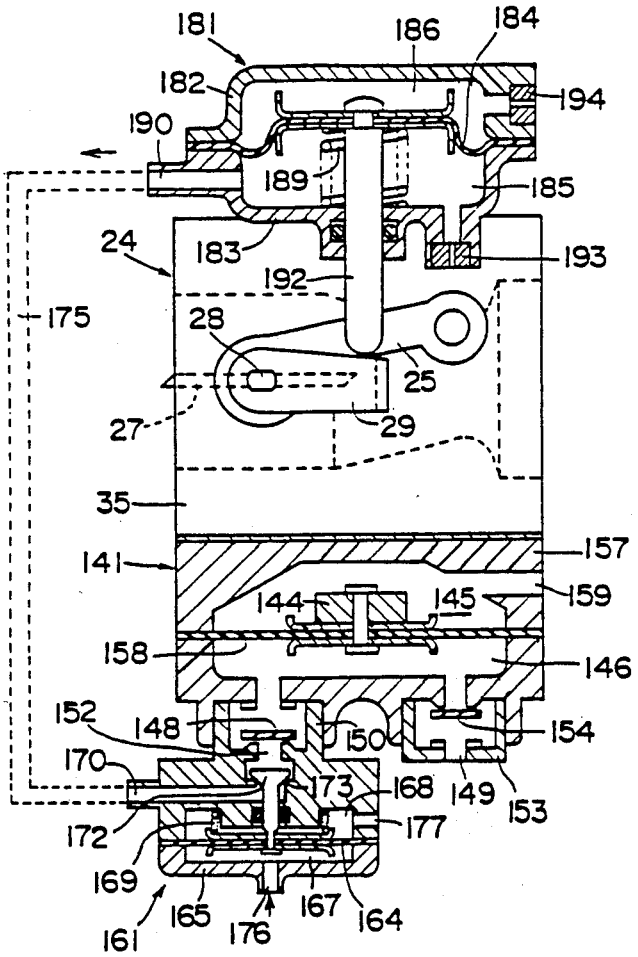

In the embodiment shown in FIG. 5, an actuator 181 connected to the upper end wall of the body 35 of the carburetor 24, is actuated by negative pressure supplied from a vibrating pump 141 through a control valve 161. Members corresponding to those shown in FIGS. 1 and 3 are indicated by reference numerals to which 100 is added. Provided in an atmospheric opening 149 of the vibrating pump 141 is a check valve 154 to allow a flow of air from a pressure chamber 146 to the outside. On the other hand, provided on a passage 152 is a check valve 148 to allow a flow of air from the control valve 161 to the pressure chamber 146.

The control valve 161 is designed so that a valve body 172 is urged against valve seat 173 in the connection of a passage 152 and 170 by means of a spring 169 positioned in a housing integral with a port member 150. A passage 170 connects a pressure chamber 185 of an actuator 181 through a pipe 175.

The actuator 181 has a diaphragm 184 sandwiched between housings 182 and 183 to form an atmospheric chamber 186 and pressure chamber 185, the atmospheric chamber 186 and pressure chamber 185 being connected with atmosphere by orifices 194 and 193, respectively. A rod 192 connected to the diaphragm 184 is retracted by the force of a spring 189.

When the engine exceeds a predetermined number of revolutions to increase vibrations, the diaphragm 158 is vibrated up and down by the weight 144 of the vibrating pump 141. On the other hand, the air pressure in the outlet of the cooling fan 17 acts on the diaphragm 164 in the pressure chamber 167 from the port 176, and the valve body 172 is moved upward against the force of the spring 169 to open the passage 152. Accordingly, air in the pressure chamber 185 of the actuator 181 is taken into the pressure chamber 146 through the pipe 175, the control valve 161, and the check valve 148, and thence discharged from the pressure chamber 146 through the check valve 154 to the outside. In this manner, the pressure chamber 185 is negative in pressure, the rod 192 is urged down against the force of the spring 189, the throttle valve lever 29 is rotated clockwise, the opening of the throttle valve 27 is reduced, and the number of revolutions of the engine decreases.

It is to be noted in the embodiment shown in FIG. 5 that instead of feeding a positive pressure generated by the cooling fan 17 to the chamber 167, a negative pressure generated by the cooling fan may be fed from the port 177 to the chamber 168 to achieve the similar effect.

Figure 6:
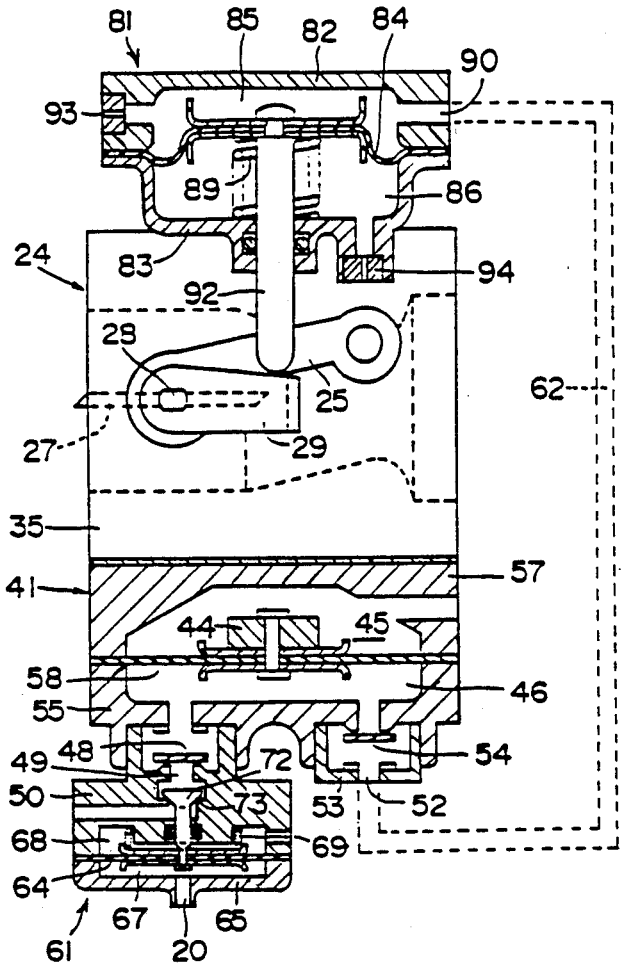
Figure 7:
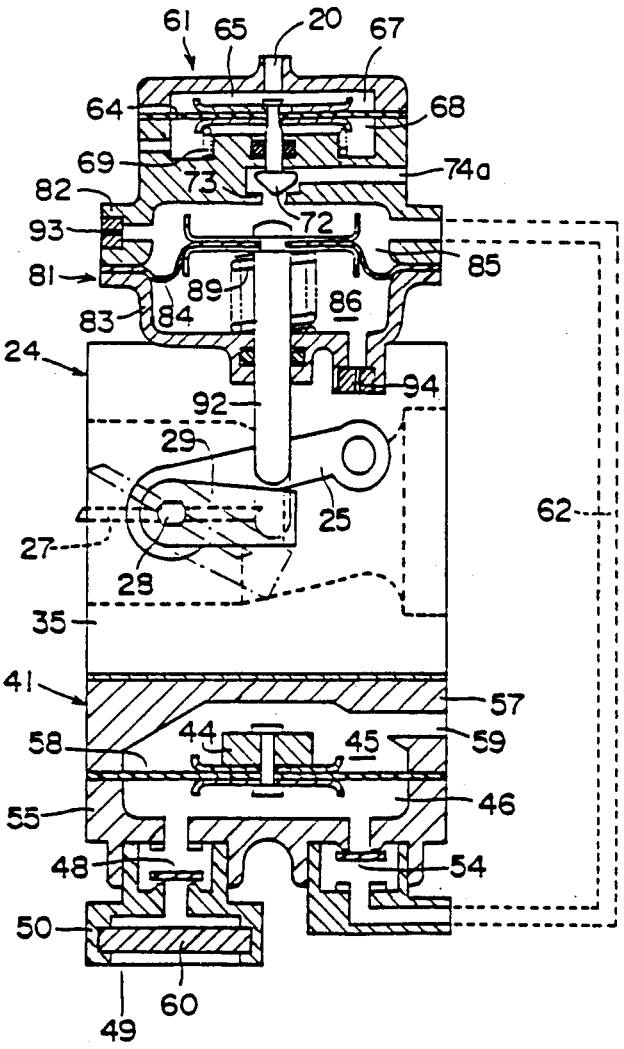

While in the above-described embodiments the control valve is provided between the vibrating pump and the actuator, it is to be noted that as shown in FIG. 6, a control valve may be connected to an inlet port of a vibrating pump so as to actuate the vibrating pump only during overrunning of the engine, and that, as shown in FIG. 7, a control valve may be connected to a pressure chamber of an actuator so that normally, the actuation of the actuator is cancelled and, only at the time of overrunning of the engine, is the actuator actuated.

In the embodiment shown in FIG. 6, the control valve 61 is connected to the inlet side of the vibrating pump 41, namely, to the side of the check valve 48. The housing of the control valve 61 is integrally formed with a port member 50. An outlet port of the vibrating pump 41, that is, at the side of the check valve 54, is connected to a pressure chamber of an actuator 81 by means of a pipe 62. The structures of the vibrating pump 41, actuator 82 and control valve 61 are similar to those in the embodiment shown in FIG. 3. Similar members are indicated by the reference numerals previously used and further description thereof will be omitted.

In this embodiment, in the normal running of the engine, since the inlet port of the vibrating pump 41, that is, the atmospheric opening 49 is closed by the control valve 61, the actuation of the diaphragm 58 is restrained even when subjected to the vibration of the engine, and the rod 92 of the actuator 81 is forced upward by the force of the spring 89. When the engine takes the mode of overrunning, air pressure supplied from the outlet port of the cooling fan through 20 to the chamber 67 increases, and the valve body 72 is formed upward against the force of the spring 69 and the inlet port of the vibrating pump 41 is opened to atmosphere. Accordingly, the diaphragm 58 of the vibrating pump 41, subjected to the vibration of the engine, is reciprocated to supply air under pressure from the pressure chamber 46 to the pressure chamber 85 of the actuator 81 through the check valve 54 and the pipe 62. The rod 92 is then forced down against the force of the spring 89, and the throttle valve 27 is rotated along with the throttle valve lever 29 in the direction of closing the valve.

In the embodiment shown in FIG. 7, the vibrating pump 41 is connected to the actuator 81 through a pipe 62. The control valve 61 is integrally formed with the housing of the actuator 81, and is of the normal open type valve in which the pressure chamber 85 of the actuator 81 is connected to an atmospheric opening 74*a*. The other structures are similar to those shown in FIG. 3, and similar members are indicated by the reference numerals previously used, and further description thereof will be omitted.

In this embodiment, when the engine takes the momde of overrunning, air pressure supplied from the outlet port of the cooling fan through passage to the pressure chamber 67 of the control valve 61 increases, and the valve body 72 is forced down against the force of the spring 69 to close the atmospheric opening 74*a*. Accordingly, the vent of chamber 86 of actuator 81 having been closed, the rod 92 is forced downward by the air pressure reaching chamber 85 from the vibrating pump 41, and the throttle valve 27 is rotated along with the throttle valve lever 29 in the closing direction.

As described above, the present invention comprises an actuator for actuating a throttle valve of a carburetor in a closing direction, a control valve for controlling pressure to the actuator when the engine is overrun, and a vibrating pump actuated by the vibration of the engine, said control valve being actuated by air pressure of a cooling fan of the engine.

The actuation of the vibrating pump or the actuator is positive and well defined, and therefore the relationship between the air pressure (positive or negative pressure) of the cooling fan for actuating the diaphragm type control valve and the number of revolutions of the engine is very stable. The control valve is steadier, positive in operation, and the reliability thereof is enhanced.

According to the present invention, the opening of the throttle valve of the carburetor is automatically reduced when the engine is overrun to reduce the flow rate of a fuel-air mixture when taken into the engine. Therefore, there is provided a new anti-overrunning device which is positive in operation, may be run at a substantially reasonable fuel cost (rate of fuel consumption) in all running levels of the engine, is free of spark plug fouling, produces less exhaust fume, and less tar is accumulated in the muffler.

Furthermore, since the operator can perform his work while a throttle handle is left fully opened, because of actuation of the anti-overrunning device, the working efficiency may be enhanced, and the damage to, and the shortening of life of, the engine may be avoided.

We claim:

1. An anti-overrunning device for an internal combustion engine comprising an actuator responsive to control pressure for actuating a throttle valve of a carburetor in a direction of closing the valve, a vibrating pump actuated by vibration of the engine for directing control pressure to said actuator to cause said throttle valve to move in a closing direction, and a control valve actuated by air pressure of an engine cooling fan to connect said pump to said actuator to cause said throttle valve to move in a closing direction under conditions of overrun of said engine.

* * * * *

UNITED STATES PATENT AND TRADEMARK OFFICE

CERTIFICATE OF CORRECTION

PATENT NO. : 4,796,578

DATED : January 10, 1989

INVENTOR(S) : Kohji Nagasaka, Takeshi Kobayashi, Yoshimi Sejimo

It is certified that error appears in the above-identified patent and that said Letters Patent is hereby corrected as shown below:

Col. 3, Line 7, change "3" to -- 13 --.

Col. 3, Line 29, change "28" to -- 38 --.

Col. 3, Line 30, change "35" to -- 25 --.

Col. 3, Line 32, after "engagement" insert -- with the lever 25 whereas the other end is placed in engagement --.

Col. 5, Line 17, change "82" to -- 92 --.

Col. 6, Line 56, change "82" to -- 81 --.

Col. 7, Line 24, change "momde" to -- mode --.

Signed and Sealed this

Sixth Day of June, 1989

*Attest:*

*Attesting Officer*

DONALD J. QUIGG

*Commissioner of Patents and Trademarks*